US011221014B2

(12) United States Patent
Ma et al.

(10) Patent No.: US 11,221,014 B2
(45) Date of Patent: Jan. 11, 2022

(54) IMPELLER AND CENTRIFUGAL FAN HAVING THE IMPELLER

(71) Applicant: NIDEC CORPORATION, Kyoto (JP)

(72) Inventors: Qiang Ma, Kyoto (JP); Toshifumi Fukui, Kyoto (JP); Fengwen Yang, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 62 days.

(21) Appl. No.: 16/737,907

(22) Filed: Jan. 9, 2020

(65) Prior Publication Data

US 2020/0256349 A1 Aug. 13, 2020

(30) Foreign Application Priority Data

Feb. 12, 2019 (CN) ..... 201910111269.X

(51) Int. Cl.

| | |
|---|---|
| ***F04D 29/28*** | (2006.01) |
| ***F04D 29/22*** | (2006.01) |
| ***F04D 25/04*** | (2006.01) |
| ***F04D 17/08*** | (2006.01) |

(52) U.S. Cl.

CPC ..... *F04D 29/2222* (2013.01); *F04D 17/08* (2013.01); *F04D 25/045* (2013.01); *F04D 29/281* (2013.01)

(58) Field of Classification Search

CPC .... F04D 17/08; F04D 25/045; F04D 29/2222; F04D 29/281

See application file for complete search history.

(56) References Cited

U.S. PATENT DOCUMENTS

| | | | | | |
|---|---|---|---|---|---|
| 4,470,753 | A * | 9/1984 | Witzel | B60H 1/00471 | 415/116 |
| 4,639,193 | A * | 1/1987 | Reichert | F04D 29/281 | 416/184 |
| 5,591,008 | A * | 1/1997 | Wrobel | F04D 29/662 | 416/144 |
| 5,746,577 | A * | 5/1998 | Ito | F04D 17/162 | 416/178 |
| 5,814,908 | A * | 9/1998 | Muszynski | F04D 25/082 | 310/62 |
| 2016/0290352 | A1 | 10/2016 | Hayamitsu | | |

FOREIGN PATENT DOCUMENTS

| | | |
|---|---|---|
| CN | 203939768 | 11/2014 |
| CN | 205423309 | 8/2016 |
| CN | 106015037 | 10/2016 |

* cited by examiner

*Primary Examiner* — Ninh H. Nguyen
(74) *Attorney, Agent, or Firm* — JCIPRNET

(57) ABSTRACT

An impeller and a centrifugal fan having the impeller are provided. The impeller rotates about a central axis, and includes: a cup portion, provided with a bottom portion and a cylindrical portion; a base portion, extending from a radially outermost end of the cup portion toward a radially outer side; a plurality of vanes, located on the radially outer side of the cup portion; and a ring portion, connected with end portions of the vanes on the radially outer side. The impeller further includes a plurality of rib portions, formed on a surface of a side opposite to another side of the base portion where the vanes are provided. Each of the rib portions is disposed axially opposite to at least a portion of a corresponding one of the vanes, and the rib portion and the vane is separated by the base portion.

19 Claims, 4 Drawing Sheets

IMPELLER AND CENTRIFUGAL FAN HAVING THE IMPELLER

CROSS REFERENCE TO RELATED APPLICATIONS

This application claims the priority benefit of Chinese Patent Application No. 201910111269.X, filed on Feb. 2, 2019. The entirety of the above-mentioned patent application is hereby incorporated by reference herein and made a part of this specification.

BACKGROUND

Technical Field

The disclosure relates to an airflow generation device, and particularly relates to an impeller and a centrifugal fan having the impeller.

Description of Related Art

Some electromechanical apparatuses require a centrifugal fan having an impeller. The centrifugal fan generates airflow when the impeller rotates so as to realize air circulation, discharge exhaust gas, dissipate heat, collect dust, etc.

It should be noted that the introduction in Background is merely provided for the convenience of clearly and comprehensively describing the technical solutions of the disclosure and facilitating the understanding of those skilled in the art. These technical solutions shall not be deemed well-known by those skilled in the art simply for having been described in Background.

In the conventional art, since the impeller needs to meet a prescribed strength requirement, the thickness of a supporting portion for supporting vanes in the impeller needs to be maintained at a certain level. Thus, it is difficult for the impeller to meet the strength requirement while having a light weight.

SUMMARY

According to an aspect of the disclosure, an impeller is provided. The impeller rotates about a central axis and includes: a cup portion, a base portion, a plurality of vanes, a ring portion, and a plurality of rib portions. The cup portion includes a bottom portion and a cylindrical portion. The bottom portion centering at the central axis is disk-shaped, and the cylindrical portion extends from a periphery of the bottom portion toward an axial side as well as a radially outer side. The base portion extends from a radially outermost end of the cup portion toward the radially outer side. The vanes are located on the radially outer side of the cup portion and arranged on a surface of the base portion along a circumferential direction. The ring portion is connected with end portions of the vanes on the radially outer side. The rib portions are formed on a surface of a side opposite to another side of the base portion where the vanes are provided. Each of the rib portions is disposed axially opposite to at least a portion of a corresponding one of the vanes, and the rib portion and the vane are separated by the base portion.

According to another aspect of the disclosure, a centrifugal fan is provided. The centrifugal fan includes the above impeller, a bottom plate, and a motor. The bottom plate is arranged on a side of the base portion where the rib portions are provided. The motor is accommodated in a space defined by the cup portion of the impeller and the bottom plate.

The above and other elements, features, steps, characteristics and advantages of the present disclosure will become more apparent from the following detailed description of the preferred embodiments with reference to the attached drawings.

DESCRIPTION OF THE EMBODIMENTS

The foregoing and other features of the disclosure will become apparent from the following specification with reference to the accompanying drawings. Specific embodiments of the disclosure are disclosed in the specification and the accompanying drawings. The specification and the accompanying drawings describe several embodiments to which the principles of the disclosure are applicable. However, it should be understood that, the disclosure is not limited to the embodiments described herein, but shall include all modifications, variations and equivalents falling within the scope of the appended claims.

In the embodiments of the disclosure, the singular form of "a", "the", and the like include the plural form, and should be broadly understood as "a kind" or "a category" rather than limited to "one". In addition, the term "the" should be understood to include both the singular form and the plural form, unless the context clearly indicates otherwise. In addition, the term "according to" should be understood to mean "at least in part according to", and the term "based on" should be understood to mean "at least in part based on", unless the context clearly dictates otherwise.

In the following description of the disclosure, for the convenience of description, a center line about which an impeller (or a centrifugal fan) rotates is referred to as a "central axis", a direction that is the same as or parallel to a direction in which the central axis extends is referred to as an "axial direction", a direction of a radius centering at the central axis is referred to as a "radial direction", and a direction around the central axis is referred to as a "circumferential direction".

The following describes the embodiments of the disclosure with reference to the accompanying drawings.

Embodiment 1

Figure 1:
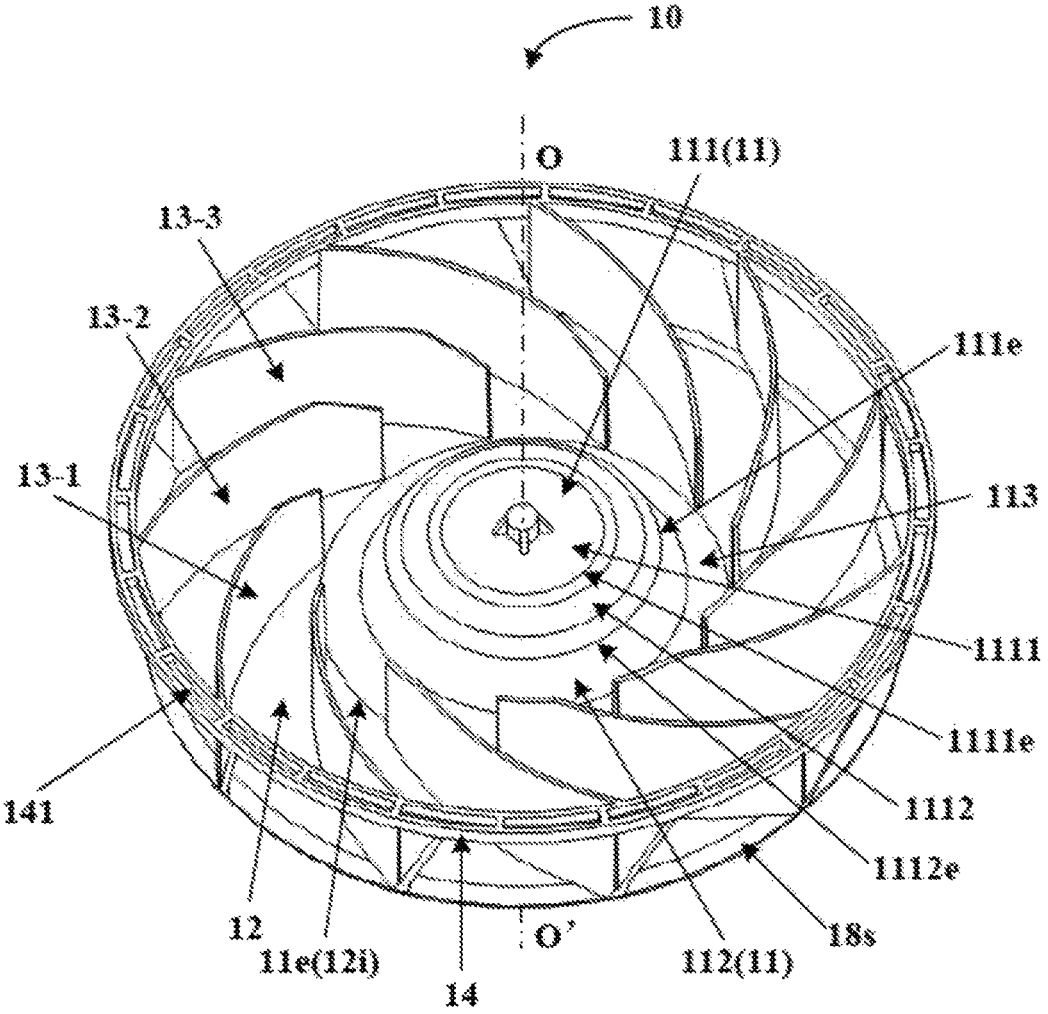
FIG. 1 is a three-dimensional view of an impeller of Embodiment 1 of the disclosure when the impeller is observed from an axial side.
Figure 2:
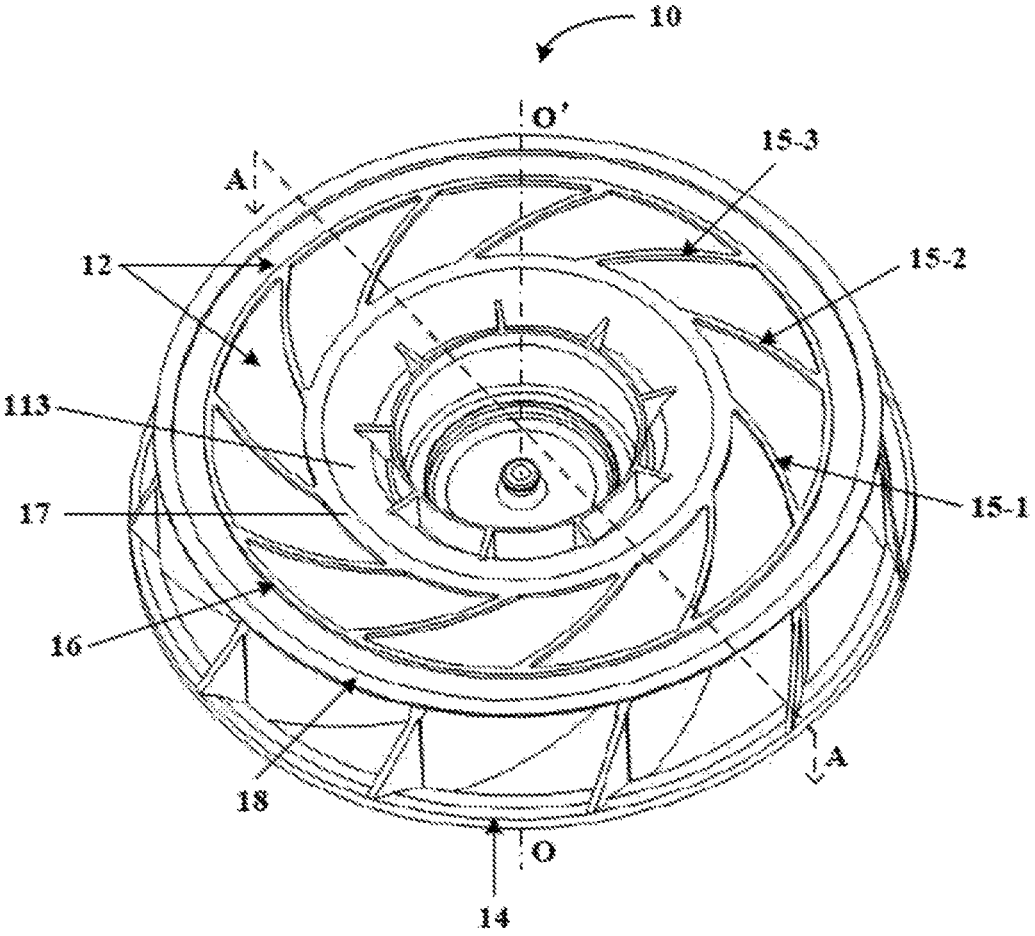
FIG. 2 is a three-dimensional view of the impeller of Embodiment 1 of the disclosure when the impeller is observed from another axial side.
Figure 3:
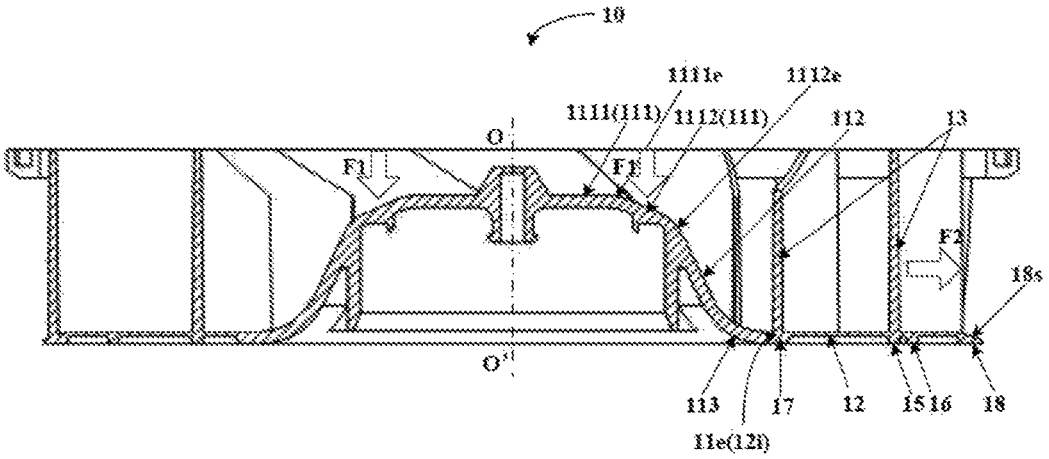
FIG. 3 is a cross-sectional view of the impeller of Embodiment 1 of the disclosure when the impeller is cut open along an A-A direction shown in FIG. 2.

Embodiment 1 provides an impeller. FIG. 1 is a three-dimensional view of the impeller of the present embodiment when the impeller is observed from an axial side. FIG. 2 is a three-dimensional view of the impeller of the present embodiment when the impeller is observed from another axial side. FIG. 3 is a cross-sectional view of the impeller of the present embodiment when the impeller is cut open along an A-A direction shown in FIG. 2.

As shown in FIG. 1, the impeller 10 rotates about a central axial O-O', and includes a cup portion 11, a base portion 12, a plurality of vanes 13-1, 13-2, 13-3, etc., and a ring portion 14. As shown in FIG. 2, the impeller 10 further includes a plurality of rib portions 15-1, 15-2, 15-3, etc.

As shown in FIG. 1, the cup portion 11 includes a bottom portion 111 and a cylindrical portion 112. The bottom portion 111 centers at the central axis O-O' and is disk-shaped, and the cylindrical portion 112 extends from a periphery 111*e* of the bottom portion 111 toward an axial side (i.e., the side O' shown in FIG. 1) and a radially outer side. The base portion 12 extends from a radially outermost end 11*e* of the cup portion 11 toward the radially outer side. The vanes 13-1, 13-2, 13-3, . . . (the vanes 13-1, 13-2, 13-3, . . . are collectively referred to as vanes 13 in the following) are located on the radially outer side of the cup portion 11 and arranged on a surface (a surface of the side O shown in FIG. 1) of the base portion 12 along a circumferential direction. The ring portion 14 is connected with end portions of the vanes 13 on the radially outer side.

As shown in FIG. 2, the rib portions 15-1, 15-2, 15-3, . . . (the rib portions 15-1, 15-2, 15-3, . . . are collectively referred to as rib portions 15 in the following) are formed on a surface of a side (the side O' shown in FIG. 2) opposite to the side of the base portion 12 where the vanes 13 are provided. As shown in FIG. 3, each of the rib portions 15 is disposed axially opposite to at least a portion of a corresponding one of the vanes 13, and the rib portion 15 and the vane 13 are separated by the base portion 12.

In the present embodiment, the bottom portion 111 centering at the central axis O-O' and disk-shaped means that the bottom portion 111 centers at the central axis O-O' is in an exact disk shape or is substantially in a disk shape.

In the present embodiment, as shown in FIG. 1, the cylindrical portion 112 extending from the periphery 111*e* of the bottom portion 111 toward the axial side (i.e., the side O' shown in FIG. 1) as well as the radially outer side means that the extending direction of the cylindrical portion 112 includes a component extending toward the axial side as well as a component extending toward the radially outer side.

In the present embodiment, each of the rib portions 15 is disposed axially opposite to at least a portion of a corresponding one of the vanes 13, and the rib portion 15 and the vane 13 are separated by the base portion 12. In other words, when observed along the axial direction, the position where each rib portion 15 is disposed at least partially overlaps the position where the corresponding vane 13 is set.

Through the foregoing embodiment, since the rib portions 15 respectively axially opposite to at least a portion of the corresponding vanes 13 are formed on the surface of the base portion 12 of the impeller, and the rib portions 15 and the vanes 13 are separated by the base portion 12, the impeller 10 can meet a strength requirement, while the thickness of the base portion 12 as required can be reduced, so that the impeller can be lighter. In addition, the ring portion 14 is connected with the end portions of the vanes 13 on the radially outer side to reinforce the fixing of the ring portion 14 and the vanes 13.

In the present embodiment, the rib portions 15 and the base portion 12 may be formed integrally or separately.

In an example, as shown in FIG. 1 and FIG. 2, each rib portion 15 may be axially opposite to the middle portion of the corresponding vane 13. However, the embodiment is not limited thereto. Each rib portion 15 may also be opposite to the end portion on a side of the corresponding vane 13, or may also be axially opposite to the entirety of the corresponding vane 13. In addition, the length and the extending direction of each rib portion 15 may be arbitrarily determined according to a need for meeting the strength requirement.

In the present embodiment, as shown in FIG. 1, when observed along the axial direction, the vanes 13 may extend to a position of a radially inner end 12*i* of the base portion 12. In other words, the vanes 13 may extend to a position of the radially outer end 11*e* of the cup portion 11.

As shown in FIG. 1 and FIG. 3, the cup portion 11 may further include a chamfered structure 113 formed at the end portion of the axial side (i.e., the side O' shown in FIG. 1) of the cylindrical portion 112. The chamfered structure 113 is connected with the cylindrical portion 112 and the base portion 12. As shown in FIG. 3, the chamfered structure 113 may have a shape of a curved surface, such as an R-angle structure, but the present embodiment is not limited thereto. The chamfered structure 113 may also be formed an inclined planar shape. In a case that the chamfered structure 113 is formed, a radially outer end of the chamfered structure 113 serves as the radially outer end 11*e* of the cup portion 11, that is, the position of the radially outer end of the chamfered structure 113 overlaps the position of the radially inner end 12*i* of the base portion 12. In such case, the vanes 13 may extend to the position of the radially outer end of the chamfered structure 113. By setting the chamfered structure, the flowing resistance of the exhausted gas can be prevented from increasing, so the air supply efficiency can be improved.

However, the present embodiment is not limited to the above example, and the chamfered structure 113 may also be omitted from the cup portion 11. In a case that the chamfered structure 113 is not provided, the radially outer end of the cylindrical portion 112 serves as the radially outer end 11*e* of the cup portion 11, that is, the position of the radially outer end of the cylindrical portion 112 overlaps the position of the radially inner end 12*i* of the base portion 12. At this time, the vanes 13 may extend to the position of the radially outer end of the cylindrical portion 112.

In the present embodiment, the cup portion 11 and the base portion 12 may be formed integrally or separately. In addition, all the components included in the cup portion 11 may also be formed integrally or separately.

In the present embodiment, as shown in FIG. 2, a ring-shaped rib portion 16 may be further formed on the surface of the side opposite to the side of the base portion 12 where the vanes 13 are provided. The ring-shaped rib portion 16 centers at the central axis O-O' and is connected with the rib portions 15. By disposing the ring-shaped rib portion 16, the impeller 10 can be further strengthened.

FIG. 2 illustrates a case of one ring-shaped rib portion 16, but the present embodiment is not limited thereto. There may be a plurality of ring-shaped rib portions 16.

In the present embodiment, the ring-shaped rib portion 16 may be arranged at any position connected with the rib portions 15. As shown in FIG. 2, the ring-shaped rib portion 16 may be arranged as being connected with the end portions of the rib portions 15 on the radially outer side, but the present embodiment is not limited thereto. The ring-shaped rib portion 16 may also be connected with middle portions of the rib portions 15.

In addition, as shown in FIG. 2, an axial side (i.e., the side O' shown in FIG. 1) of the base portion 12 may be further provided with a thickened layer 17 continuously formed with the cup portion 11 on the radially outer side of the cup portion 11. However, the present embodiment is not limited thereto, and the thickened layer 17 may also be arranged as not being continuously formed with the cup portion 11 but being provided with a clearance with respect to the cup portion 11. At this time, the thickened layer 17 serves as the ring-shaped rib portion connected with the end portions of the rib portions 15 on the radially inner side.

In the present embodiment, as shown in FIG. 2, the rib portions 15 may be arranged equidistantly along the circumferential direction. However, the present embodiment is not limited thereto, and the rib portions 15 may also be arranged along the circumferential direction without being equidistant with each other.

In the present embodiment, a ratio of an axial thickness of each rib portion 15 to an axial thickness of the base portion 12 may be arbitrarily set according to an actual need. For example, the ratio may be set as greater than 0 and not greater than 2. Within this range, the impeller 10 may maintain higher strength but have a light weight.

In the present embodiment, when observed along the axial direction, a width of the rib portion 15 may be arbitrarily set according to an actual need. For example, the width may be set to be equal to or less than a width of the vane 13. Within this range, the impeller 10 may have an even lighter weight. Still, the present embodiment is not limited thereto, and the width may be set to be greater than the width of the vane 13.

In the present embodiment, as shown in FIG. 1 and FIG. 3, the bottom portion 111 may further include a planar portion 1111 and a curved surface portion 1112. The planar portion 1111 centers at the central axis O-O' and extends along a planar direction perpendicular to the central axis O-O'. The curved surface portion 1112 is located on the radially outer side of the planar portion 1111, and extends from a periphery 1111*e* of the planar portion 1111 along a curved surface direction. The cylindrical portion 112 extends from a periphery 1112*e* of the curved surface portion 1112 toward an axial side (i.e., the side O' shown in FIG. 1) as well as the radially outer side. By disposing the curved surface portion 1112, air intake is smoother in the vicinity of an air intake position F1 of the impeller 10. Accordingly, the air flow from an air suction port is facilitated, and the air intake efficiency is facilitated.

In the present embodiment, as shown in FIG. 2 and FIG. 3, the impeller 10 may further include an outer ring portion 18 extending from the periphery of the base portion 12 toward the radially outer side, and an axial thickness of the radially inner end of the outer ring portion 18 is greater than that of the base portion 12. Therefore, the strength of the impeller 10 may be further increased at a peripheral position. A radial width of the outer ring portion 18 may be arbitrarily set according to an actual need. Furthermore, the outer ring portion 18 and the base portion 12 may be formed integrally or separately.

In addition, as shown in FIG. 1 and FIG. 3, the outer ring portion 18 may be formed to include an inclined surface 18*s* inclined with respect to the extending direction of the base portion 12 on a side close to the ring portion 14. As shown in FIG. 3, an axial thickness of the outer ring portion 18 is gradually reduced along a direction from the radially inner side of the inclined surface 18*s* toward the radially outer side. Therefore, air discharging may be smoother in the vicinity of an air discharging position F2 of the impeller 10, and thus the flowing resistance of the exhausted gas may can be prevented from increasing, so the air supply efficiency can be improved.

The present embodiment is not limited to the foregoing example. The outer ring portion 18 may be omitted. Alternatively, the outer ring portion 18 may be provided without the inclined surface 18*s*. In such case, an end surface of a side of the outer ring portion 18 close to the ring portion 14 is parallel to the extending direction of the base portion 12.

In the present embodiment, as shown in FIG. 1, a plurality of recess portions 141 may also be formed on an end surface of a side of the ring portion 14 away from the base, and the recess portions 141 are arranged along the circumferential direction. Therefore, one or more of the recess portions 141 may be appropriately filled with a material for adjusting the mass according to an actual need, and the rotational balance can therefore be modified and the weight can be light.

With the impeller 10 of the present embodiment, since the rib portions 15 respectively axially opposite to at least a portion of the corresponding vanes 13 are formed on the surface of the base portion 12 of the impeller, and the rib portions 15 and the vanes 13 are separated by the base portion 12, the impeller 10 can meet the strength requirement, and the thickness of the base portion 12 as required can be reduced, so that the impeller 10 can be light.

Embodiment 2

Figure 4:
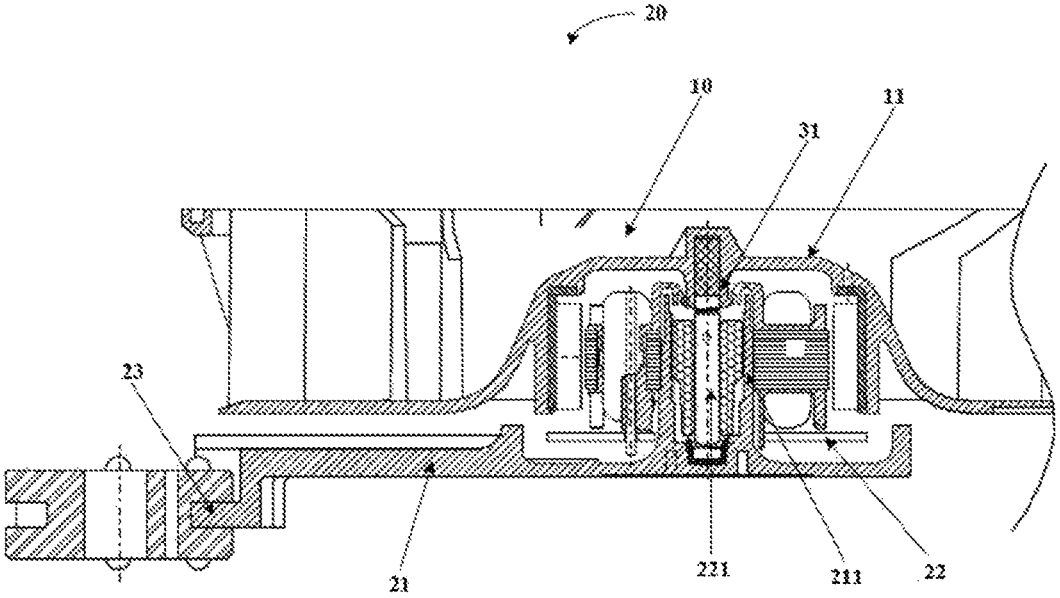
FIG. 4 is a portion of a cross-sectional view of a centrifugal fan of Embodiment 2 of the disclosure when the centrifugal fan is cut open along a plane on which the axial direction is located.

The present embodiment 2 provides a centrifugal fan. FIG. 4 is a portion of a cross-sectional view of the centrifugal fan when the centrifugal fan is cut open along a plane on which the axial direction is located.

As shown in FIG. 4, the centrifugal fan 20 includes the impeller 10, a bottom plate 21 and a motor 22.

A structure of the impeller 10 is as described in the above Embodiment 1, and descriptions thereof are omitted here. As shown in FIG. 4, the bottom plate 21 is arranged on a side of the base portion 12 where the rib portions 15 are provided. The motor 22 is accommodated in a space defined by the cup portion 11 of the impeller 10 and the bottom plate 21, and may drive the impeller 10 to rotate.

In the present embodiment, as shown in FIG. 4, the impeller 10 may be provided with a motor mounting portion 31 on a side of the cup portion 11 facing the bottom plate 21. The motor 22 includes a rotating shaft 221. One end of the rotating shaft 221 is fixed on the motor mounting portion 31. A motor supporting portion 211 may be arranged on a surface of a side of the bottom plate 21 facing the cup portion, and support the motor 22 to be freely rotatable. In this way, the impeller 10 may rotate as the motor 22 and the rotating shaft 221 thereof rotate.

In FIG. 4, the motor mounting portion 31 is arranged as a protruding structure with a hole portion. One end of the rotating shaft 221 of the motor 22 is fixed in the hole. The motor supporting portion 211 is formed in substantially a tower shape. The other end of the rotating shaft 221 of the motor 22 is inserted into the tower-shaped motor supporting portion 211. However, the present embodiment is not limited thereto. The motor mounting portion 31 and the motor supporting portion 211 of the present embodiment may also be of other shapes or structures.

The centrifugal fan of the present embodiment is suitable for various electromechanical apparatuses, such as household appliances including a refrigerator, an air conditioner, a dust collector, a water heater, or a refrigeration apparatus, an exhaust apparatus, a slag removal apparatus, a dust collection apparatus and the like for an industrial purpose. The present embodiment is not limited to the apparatuses listed above. The centrifugal fan may also be applied to other types of electromechanical apparatus.

In the present embodiment, as shown in FIG. 4, the centrifugal fan 20 may also include a mounting portion 23 for mounting the bottom plate 21 on an electromechanical apparatus. In this way, the centrifugal fan 20 may be mounted on the electromechanical apparatus.

According to the centrifugal fan 20 of the present embodiment, since the rib portions respectively axially opposite to at least a portion of the corresponding vanes 13 are formed on the surface of the base portion of the impeller of the centrifugal fan 20, and the rib portions 15 and the vanes 13 are separated by the base portion 12, the impeller of the centrifugal fan 20 can meet the strength requirement, and the thickness of the base portion as required can be reduced, so that the centrifugal fan 20 can be lighter.

Features of the above-described preferred embodiments and the modifications thereof may be combined appropriately as long as no conflict arises. While preferred embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. An impeller, rotating about a central axis and comprising:

a cup portion, comprising a bottom portion and a cylindrical portion, wherein the bottom portion centering at the central axis is disk-shaped, and the cylindrical portion extends from a periphery of the bottom portion toward an axial side as well as a radially outer side;

a base portion, extending from a radially outermost end of the cup portion toward the radially outer side;

a plurality of vanes, located on the radially outer side of the cup portion and arranged on a surface of the base portion along a circumferential direction; and a ring portion, connected with end portions of the vanes on the radially outer side, wherein the impeller further comprises:

a plurality of rib portions, formed on a surface of a side opposite to another side of the base portion where the vanes are provided, wherein each of the rib portions is disposed axially opposite to at least a portion of a corresponding one of the vanes, and the rib portion and the vane are separated by the base portion, wherein a ring-shaped rib portion centering at the central axis and connected with the rib portions is further formed on the surface of the side opposite to the another side of the base portion where the vanes are provided, and the ring-shaped rib portion extends axially from the base portion in a direction opposite the vanes.

2. The impeller according to claim 1, wherein the ring-shaped rib portion is disposed at a radial direction inner side of an outer ring portion.

3. The impeller according to claim 1, wherein a thickened layer is disposed at a radial direction inner end of the plurality of rib portions, and each radial direction inner end of the plurality of rib portions is connected to the thickened layer.

4. The impeller according to claim 3, wherein the ring-shaped rib portion is disposed at a radial direction outer side of the thickened layer, and each radial direction outer end of the plurality of rib portions is connected to the ring-shaped rib portion.

5. The impeller according to claim 1, wherein an axial direction lower part of the ring-shaped rib portion is positioned at a same height or lower in an axial direction than the plurality of rib portions.

6. The impeller according to claim 1, wherein a number of the plurality of vanes is a prime number and a number of the plurality of rib portions is a prime number.

7. The impeller according to claim 1, wherein at least one of a radial direction outer end of the plurality of ribs is disposed between adjacent vanes.

8. The impeller according to claim 1, wherein the impeller further comprises an outer ring portion extending from a periphery of the base portion toward the radially outer side; and an axial thickness of a radially inner end of the outer ring portion is greater than an axial thickness of the base portion.

9. The impeller according to claim 8, wherein the outer ring portion is formed to comprise an end surface inclined with respect to an extending direction of the base portion on a side close to the ring portion, and an axial thickness of the outer ring portion is gradually reduced along a direction from a radially inner side toward the radially outer side.

10. The impeller according to claim 1, wherein a plurality of recess portions are formed on the end surface of a side of the ring portion that is away from the base portion, and are arranged along the circumferential direction.

11. A centrifugal fan, comprising:

the impeller according to claim 1;

a bottom plate, arranged on a side of the base portion where the rib portions are provided; and a motor, accommodated in a space defined by the cup portion of the impeller and the bottom plate.

12. An impeller, rotating about a central axis and comprising:

a cup portion, comprising a bottom portion and a cylindrical portion, wherein the bottom portion centering at the central axis is disk-shaped, and the cylindrical portion extends from a periphery of the bottom portion toward an axial side as well as a radially outer side;

a base portion, extending from a radially outermost end of the cup portion toward the radially outer side;

a plurality of vanes, located on the radially outer side of the cup portion and arranged on a surface of the base portion along a circumferential direction; and a ring portion, connected with end portions of the vanes on the radially outer side, wherein the impeller further comprises:

a plurality of rib portions, formed on a surface of a side opposite to another side of the base portion where the vanes are provided, wherein each of the rib portions is disposed axially opposite to at least a portion of a corresponding one of the vanes, and the rib portion and the vane are separated by the base portion;

wherein the impeller further comprises an outer ring portion extending from a periphery of the base portion toward the radially outer side; and an axial thickness of a radially inner end of the outer ring portion is greater than an axial thickness of the base portion;

the outer ring portion is formed to comprise an end surface inclined with respect to an extending direction of the base portion on a side close to the ring portion; and an axial thickness of the outer ring portion is gradually reduced along a direction from a radially inner side toward the radially outer side.

13. The impeller according to claim 12, wherein when observed along an axial direction, the vanes extend to a position of a radially inner end of the base portion.

14. The impeller according to claim 12, wherein a ring-shaped rib portion centering at the central axis and connected with the rib portions is further formed on the surface of the side opposite to the another side of the base portion where the vanes are provided.

15. The impeller according to claim 12, wherein the rib portions are arranged equidistantly along the circumferential direction.

16. The impeller according to claim 12, wherein a ratio of an axial thickness of the rib portion to an axial thickness of the base portion is greater than 0 and not greater than 2.

17. The impeller according to claim 12, wherein when observed along an axial direction, a width of the rib portion is equal to or less than a width of the vane.

18. The impeller according to claim 12, wherein the bottom portion comprises:

a planar portion, centering at the central axis and extending along a planar direction perpendicular to the central axis; and a curved surface portion, located on a radially outer side of the planar portion and extending from a periphery of the planar portion along a curved surface direction, wherein the cylindrical portion extends from a periphery of the curved surface portion toward an axial side as well as the radially outer side.

19. The impeller according to claim 12, wherein a plurality of recess portions are formed on the end surface of a side of the ring portion that is away from the base portion, and are arranged along the circumferential direction.

* * * * *